US005083061A

United States Patent [19]

Koshiishi et al.

[11] Patent Number: 5,083,061

[45] Date of Patent: Jan. 21, 1992

[54] ELECTRON BEAM EXCITED ION SOURCE

[75] Inventors: Akira Koshiishi, Kofu; Kohei Kawamura, Nirasaki, both of Japan

[73] Assignee: Tokyo Electron Limited, Tokyo, Japan

[21] Appl. No.: 614,600

[22] Filed: Nov. 15, 1990

[30] Foreign Application Priority Data

Nov. 20, 1989 [JP] Japan ..... 1-302730

[51] Int. Cl.[5] ..... H01J 27/02

[52] U.S. Cl. ..... 315/111.81; 315/111.21; 313/231.31; 250/423 R

[58] Field of Search ..... 315/111.21, 111.31, 315/111.81; 313/359.1, 231.31; 250/423 R

[56] References Cited

U.S. PATENT DOCUMENTS 4,409,520 10/1983 Koike et al. ..... 315/111.81 X
4,749,912 6/1988 Hara et al. ..... 315/111.81
4,841,197 6/1989 Takayama et al. ..... 315/111.81

*Primary Examiner*—Eugene R. LaRoche
*Assistant Examiner*—Do Hyun Yoo
*Attorney, Agent, or Firm*—Oblon, Spivak, McClelland, Maier & Neustadt

[57] ABSTRACT

An ion source according to the present invention includes a first chamber, including a main chamber having an electron generating arrangement therein, and a sub-chamber communicating with the main chamber through a nozzle, for producing a first plasma by a discharge. A supply is also provided for supplying a first gas for a discharge into the main chamber, as well as an electron extracting arrangement for extracting electrons from the first plasma. Also included are a second chamber for producing a second plasma by discharge excitation of the extracted electrons and ionizing a second gas as a source gas, a further supply for supplying the second gas into the second chamber, and a magnetic field generator for generating a magnetic field for guiding the extracted electrons toward the second chamber. The electron extracting arrangement includes an electrode between the sub-chamber and the second chamber. The electrode has a first hole, formed at a position opposite to the opening of the nozzle, for allowing the extracted electrons to pass therethrough and to move into the second chamber, and second holes, arranged around the first hole, for allowing part of the first gas injected from the nozzle to pass therethrough and to move into the second chamber. Part of the first gas is drawn into the second chamber through the second holes of the electrode, and the density of the first gas passing through the first hole is decreased.

15 Claims, 5 Drawing Sheets

ELECTRON BEAM EXCITED ION SOURCE

BACKGROUND OF THE INVENTION

1. Field of the Invention

The present invention relates to an ion source for generating ions by exciting a gas using an electron beam and, more particularly, to an improvement in the electrode of an ion source.

2. Description of the Related Art

An ion implantation system is widely used to dope impurity ions into a semiconductor wafer in the manufacturing process of a VLSI. An ion implantation system is required to control a desired ion implantation amount and depth with high precision. Various types of ion sources are available for an ion implantation system so that ions having various energy levels and current densities can be produced in accordance with the purpose of a process.

For example, an electron beam excited ion source includes a first chamber for generating a first plasma (argon plasma), and a second chamber for generating a second plasma ($BF_3$ plasma). The first chamber is constituted by a main chamber for generating thermoelectrons, and a sub-chamber in which a discharge gas (Ar gas or the like) is injected together with the thermoelectrons through a nozzle upon starting up. The second chamber is partitioned from the first chamber by an electrode in terms of energy potential and serves to ionize a source gas ($BF_3$ gas or the like) by electron discharge/excitation.

In the electron beam excited ion source, thermoelectrons are generated from a filament, and an Ar gas is introduced into the first chamber while a voltage is applied between the filament and the electrode. When the thermoelectrons are caused to pass through the nozzle together with the Ar gas, gas molecules are dissociated from each other by discharge, and an argon plasma is produced.

A through hole (electron beam passing hole) is formed in the electrode. When a potential is applied between the electrode and a chamber side wall, only electrons are extracted from the first plasma into the second chamber through the through hole.

The electrons are then vertically guided in the second chamber by a magnetic field. The source gas ($BF_3$ gas or the like) is introduced into the second chamber in a direction perpendicular to the propagation direction of the guided electron beams, thus exciting the source gas by PIG discharge and generating a $BF_3$ plasma.

Desired ions are extracted from the second plasma and are guided to a target (semiconductor wafer) through a guide tube so as to cause the ions to collide with the target. According to such an electron beam excited ion source, high-current-density ions can be obtained.

With a recent increase in packing density of a semiconductor device, a demand has arisen for an increase in ion production efficiency in an ion source. If the ion production efficiency is increased, a large amount of ions can be generated at low cost. This increases the throughput and decreases the running cost. In order to increase the ion production efficiency, the number of passing electrons may be increased by increasing the diameter of the electron beam passing hole of the electrode.

In the above-mentioned electron beam excited ion source, however, if the diameter of the electron beam passing hole of the electrode is increased, the first and second plasmas tend to communicate with each other through this hole. This makes the second plasma unstable. As a result, the ion production efficiency is decreased.

If the diameter of the electron beam passing hole of the electrode is reduced, the density of gas molecules passing through the hole is increased, and gas molecules collide with electrons in the hole, thus causing local discharge and generating a plasma. Owing to this new plasma, the first and second plasmas tend to communicate with each other. For this reason, a desired potential cannot be applied to an electron beam.

Each of the first and second chambers is constituted by combination of conductive and insulating members excellent in durability. However, since a plasma is produced in each chamber, the conductive member of each chamber is damaged due to the effect of the plasma such as etching and sputtering, and abraded fine particles of the conductive member are attached to the insulating member, thus causing an insulation fault.

SUMMARY OF THE INVENTION

It is an object of the present invention to provide an ion implantation system which can increase the amount of electrons to be drawn into a second chamber while maintaining first and second plasmas in a stable state, and can increase the ion production efficiency.

According to an aspect of the present invention, there is provided an ion source for producing an ionized gas by discharge excitation using an electron beam, comprising a first chamber for producing a first plasma by causing electric discharge in an electron-emitting region, the first chamber including a main chamber having electron generating means arranged therein, and a sub-chamber communicating with the main chamber through a nozzle, means for supplying a first gas for a discharge into the main chamber, electron extracting means for extracting electrons from the first plasma, a second chamber for producing second plasma by discharge excitation of the extracted electrons and ionizing a second gas as a source gas, means for supplying the second gas into the second chamber, the electron extracting means including an electrode arranged between the sub-chamber and the second chamber, and the electrode including a first hole (electron beam passing hole), formed at a position opposite to an opening of the nozzle, for allowing the extracted electrons to pass therethrough and to move into the second chamber, and second holes (vent holes), arranged around the first hole, for allowing part of the first gas injected from the nozzle to pass therethrough and to move into the second chamber.

In the ion source according to the present invention, part of the first gas is drawn into the second chamber through the second holes of the electrode, and the density of the first gas passing through the first hole is decreased. For this reason, only electrons can be easily extracted from the first plasma without excessively increasing the electrode potential of the electrode.

The first hole is preferably formed within a range in which an injected gas directly collides with the surface of the electrode. The second holes are preferably formed around the first hole. This is because if the distance from each second hole to the first hole is set to be too large, the ventilation effect is greatly reduced.

In the first chamber, those regions other than the electron-emitting region may be covered with an insulating material (e.g., boron nitride or silicon nitride).

An assembly, for preventing adhesion of flied conductive particles, is preferably provided respectively a lower portion of the electrode and a peripheral portion of a bottom plate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments give below, serve to explain the principles of the invention.

DETAILED DESCRIPTION OF THE PREFERRED EMBODIMENTS

Embodiments of the present invention will be described below with reference to the accompanying drawings.

An ion implantation system is installed in a clean room. The ion implantation system comprises an ion source 10, an analyzer magnet (not shown), an acceleration tube, X-scan plates, Y-scan plates, a Faraday cup, and an end station. The end station includes a rotating disc (not shown) for supporting a plurality of semiconductor wafers.

Figure 1:
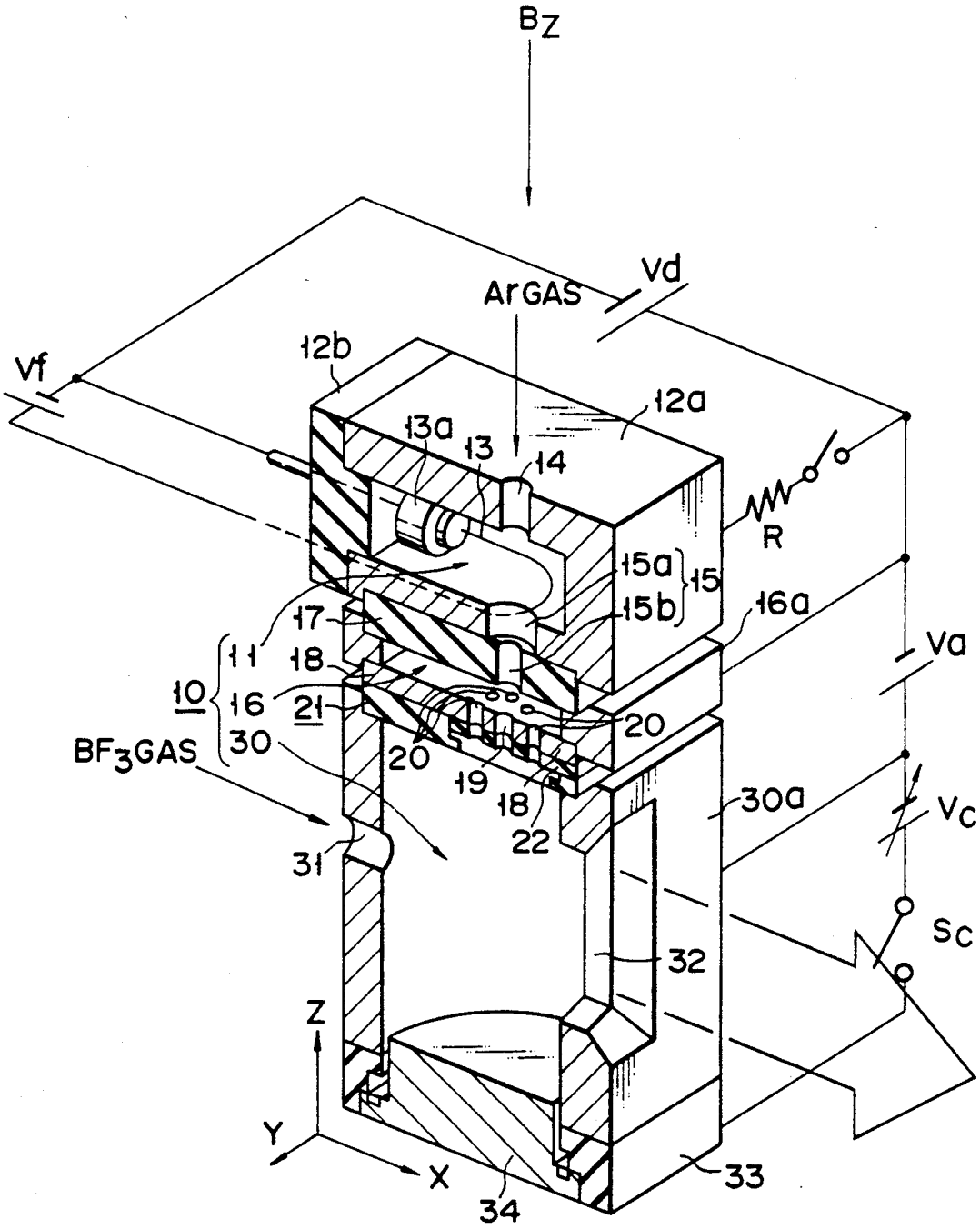
FIG. 1 is a schematic view showing an ion source according to the first embodiment of the present invention.

As shown in FIG. 1, the ion source 10 is an electron beam excited ion source which comprises an electron generating chamber (the main chamber of a first chamber) 11, a sub-chamber 16 of the first chamber, and an ion generating chamber (second chamber) 30. A magnetic field generator (not shown) is arranged above and under the main body of the ion source 10 so as to apply a magnetic field Bz in the parallel direction (Z-axis direction) in the chambers 11, 16, and 30.

The main chamber 11 is formed into a rectangular parallelepiped whose sides respectively have several centimeters. The walls of the main chamber 11 are made of a high-melting-point conductive material 12*a* such as a molybdenum alloy except for one side wall.

One side wall of the main chamber 11 is constituted by an insulating member 12*b* consisting of $Si_3N_4$ or BN. A filament 13 penetrates through the insulating member 12*b* and extends into the main chamber 11. The filament 13 is supported by the insulating member 12*b* through a member 13*a*. The filament 13 is connected to the negative side of a circuit including a DC power source Vf for heating. In addition, the filament 13 is connected to the negative side of a circuit including a DC power source Vd for controlling a current density. The positive side of the circuit including the DC power source Vd is connected to the conductive wall 16*a* of the sub chamber 16 and an electrode 18. This circuit is designed to be controlled by a controller (not shown) to maintain a constant current. That is, with this constant-current control, the filament 13 is controlled to emit a desired number of electrons.

A gas supply path 14 is formed in the upper portion of the conductive wall 12*a* of the main chamber 11. The gas supply path 14 communicates with an argon source (not shown) having a pressure regulating valve.

In the first chamber (11, 16), an insulating plate 17 is inserted between the conductive wall 12*a* of the main chamber 11 and a conductive wall 16*a* of the sub-chamber 16. The insulating plate 17 is made of $Si_3N_4$, BN, or the like. The positive side of the circuit including the DC power source Vd is connected to the conductive wall 12*a* of the first chamber 11 through a resistor R and an ON/OFF switch.

A nozzle 15 is formed to extend through the lower portion of the conductive wall 12*a* and the insulating plate 17. The main chamber 11 communicates with the sub-chamber 16 through the nozzle 15. An upper portion 15*a* (conductive portion) of the nozzle 15 has a diameter larger than that of a lower portion 15*b* (insulating portion) thereof. For example, the nozzle 15 is formed by setting the diameters of the upper and lower portions 15*a* and 15*b* to be 2 to 8 mm and 2 to 3 mm, respectively.

An electrode 18 is arranged between the sub-chamber 16 and the second chamber 30 so that the first (11, 16) and second (30) chambers are electrically separated from each other in the vertical direction through the electrode 18.

A circuit including a DC power source Va capable of applying a maximum voltage of 150 volts between the electrode 18 and a side wall 30*a* of the second chamber 30 is provided. The negative side of this circuit is connected to the electrode 18. The positive side of this circuit is connected to the chamber side wall 30*a*. This circuit serves to apply an acceleration voltage to electrons in a first plasma and is constant-voltage-controlled by a controller (not shown).

A gas introduction path 31 and an ion extraction port 32 are formed in the side wall 30*a*. The path 31 communicates with a $BF_3$ gas source (not shown) having a flow rate regulating valve so that a $BF_3$ gas is introduced into the chamber 30 through the path 31. Note that the second chamber 30 is evacuated to a pressure of several mTorr. The ion extraction port 32 is formed into an elongated slit and extends to a target through a guide.

A conductive bottom plate 34 is arranged at the bottom portion of the second chamber 30. The bottom plate 34 is electrically insulated from the side wall 30*a* through an insulating member 33. A circuit including a variable DC power source Vc is formed between the bottom plate 34 and the wide wall 30*a*. During an operation, the bottom plate 34 is set at the same potential as that in a floating state (when the switch Sc is in an OFF state) or of the electrode 18.

Figure 6:
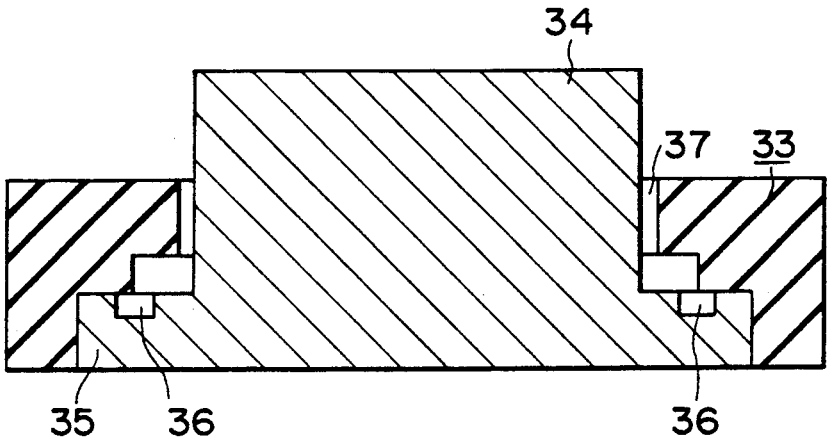
FIG. 6 is a longitudinal sectional view showing a bottom portion of an ion generating chamber (second chamber) according to the first embodiment.

As shown in FIG. 6, a flange 35 is formed around a lower portion of the bottom plate 34, and an annular groove 36 is formed in the upper surface of the flange 35. The inner surface of an opening 37 of the insulating support member 33 is formed to have a step. The insulating support member 33 serves to hold the bottom plate 34 with the flange 35 and to form a shadow for a $BF_3$ plasma by covering the upper surface of the flange 35 and substantially the half of the groove 36.

Figure 2:
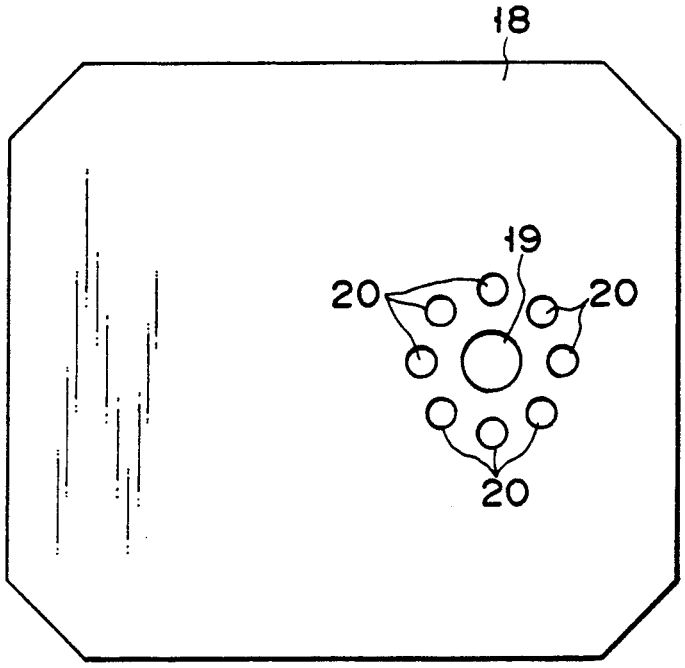
FIG. 2 is a plan view showing an anode electrode according to the first embodiment.

As shown in FIG. 2, an electron beam passing hole (first hole) 19 is formed at a proper position of the electrode 18, and eight vent holes (second holes) 20 are formed around the hole 19. The electrode 18 is made of a high-melting-point material such as tungsten because it receives an attack of a high-temperature plasma. The thickness of the electrode 18 is preferably set to fall within a range of 0.3 mm to 3.5 mm and is most preferably set to be 1.0 to 3.0 mm. This is because a thin electrode having a thickness less than 0.3 mm is poor in durability, and a thick electrode having a thickness exceeding 3.5 mm tends to cause discharge within the first hole 19.

The diameters of the first hole 19 and second holes are respectively 2.4 mm and 1.5 mm. The distance between the center of each of the eight second holes 20 and the center of the first hole 19 is 5 mm. The eight second holes 20 are arranged at an equal pitch around the first hole 19. Note that the gas supply path 14, the nozzle 15, and the electron beam passing hole 19 are concentrically aligned.

The first hole 19 of the electrode 18 is preferably formed into a circle having a diameter of 2.0 to 3.0 mm, most preferably 2.4 mm, so as to allow the largest amount of electrons to pass therethrough and to prevent contact (joint) between the first plasma (argon plasma) and the second plasma ($BF_3$ plasma). This is because if the diameter of the first hole 19 is smaller than 2.0 mm, electrons collide with the argon gas molecules to cause discharge within the hole 19. In contrast to this, if the first hole 19 has a diameter exceeding 3.0 mm, the first and second plasmas tend to come into contact (joint) with each other, and the ion production efficiency is decreased.

In order to reduce the density of a gas passing through the first hole 19, the second holes 20 are preferably formed in the electrode 18 to have the largest total area of the openings and arranged at positions as close to the first hole 19 as possible. In addition, each second hole 20 preferably has a circular or approximately circular cross-section. However, an elliptic or oval cross-section is not preferable for the following reason. If each second hole 20 has an elliptic or oval cross-section, an argon plasma and a $BF_3$ plasma may contact with each other.

In addition, four to eight second holes each having a diameter of 1.0 to 2.0 mm are preferably formed in a range of 2.5 to 10 mm from the center of the first hole 19. Especially, in consideration of the spread of an injected gas, eight second holes 20 are most preferably arranged at positions 5 mm distant from the center of the first hole 19.

Furthermore, it is preferable that the largest difference (acceleration voltage) be set between an anode electrode potential and a chamber side wall potential. If the acceleration voltage is increased, the extraction efficiency of electrons from the first plasma can be increased.

Figure 3:
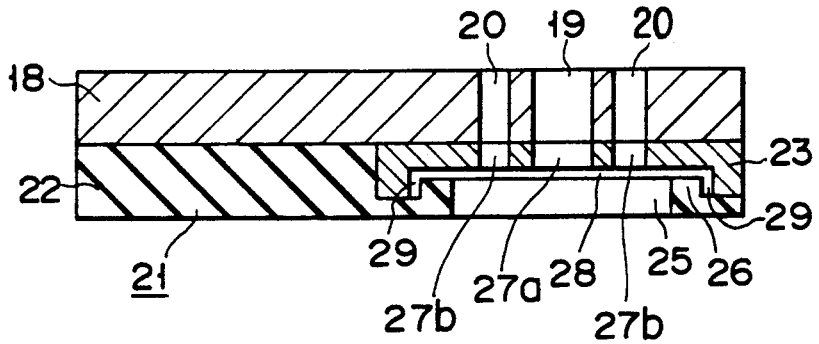
FIG. 3 is a longitudinal sectional view showing the electrode according to the first embodiment and its protective mechanism.

As shown in FIG. 3, a protective mechanism 21 is formed on the lower surface of the anode electrode 18. The protective mechanism 21 serves to protect the electrode 18 from the attack of a plasma (e.g., etching and sputtering).

Figure 4:
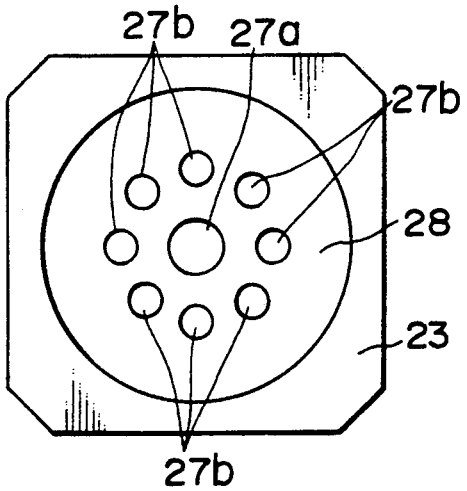
FIG. 4 is a plan view showing a conductive plate to be mounted on the protective mechanism of the electrode according to the first embodiment.

As shown in FIG. 4, two types of holes 27*a* and 27*b* are formed in a conductive plate 23 of the protective mechanism 21. The center hole 27*a* is formed to communicate with the first hole 19 of the anode electrode. The eight peripheral holes 27*b* are formed to respectively communicate with the second holes 20 of the anode electrode. Note that the conductive plate 23 consists of a material which can endure a plasma attack, e.g., a conductive ceramic material.

Figure 5:
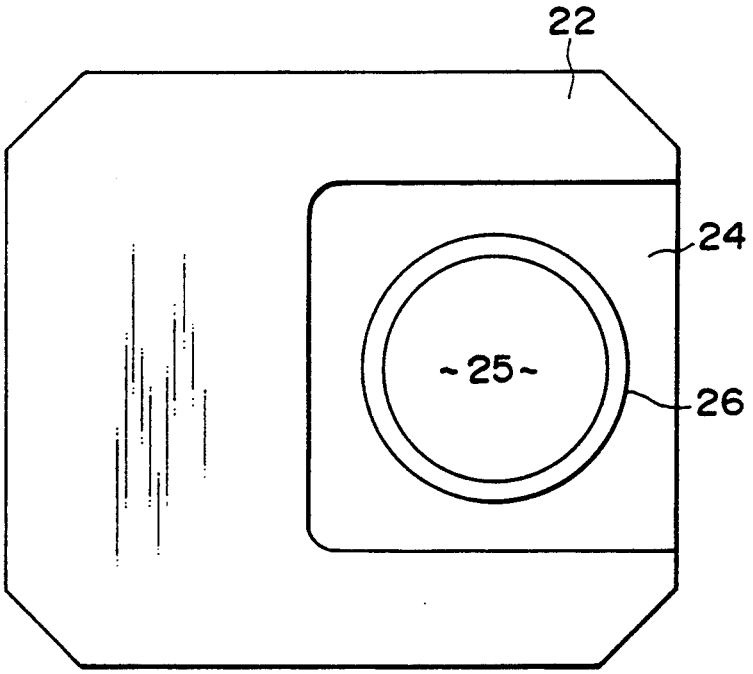
FIG. 5 is a plan view showing an insulating plate to be mounted o the protective mechanism of the electrode according to the first embodiment.

As shown in FIG. 5, an insulating plate 22, for insulating regions where potential levels are negative with reference to the first plasma produced in the first chamber and which are other than the electron-emitting region, has substantially the same outer shape as that of the electrode 18. A recess 24 is formed in the upper surface of the insulating plate 22. A circular hole 25 is formed in the recess 24. An annular projection 26 is formed around the circular hole 25 to extend upward. Note that when the electrode 18, the insulating plate 22, and the conductive plate 23 are assembled together, a contacting portion 29, as best seen in FIG. 3, between the insulating plate 22 and the conductive plate 23 serves as a shadow with respect to a $BF_3$ plasma due the presence of the projection 26 of the insulating plate 22.

Ionization of a $BF_3$ gas by means of the ion source 10 according to the first embodiment will be described below.

(I) A desired amount of thermoelectrons are generated in the first chamber 11 by supplying a current to the filament 13 while applying the magnetic field in the Z-axis direction to the main body of the ion source 10. While an argon gas is introduced into the first chamber 11 at a flow rate of 0.08 to 0.4 SCCM, a predetermined discharge voltage is applied between the wall of the first chamber 11 and the filament 13. A discharge occurs in the main chamber 11, and the argon gas is then dissociated to become a plasma. The first plasma (argon plasma) generated in this manner grows and is stabilized in the process of passing through from the nozzle 15 to the sub-chamber 16. As a result of such discharge, the service life of the filament 13 is prolonged.

(II) A predetermined acceleration voltage is applied between the electrode 18 and the side wall 30*a* to extract electrons from the first plasma. The extracted electrons pass through the first hole of the electrode so as to be introduced into the second chamber 30. The electrons are then moved downward in the Z-axis direction by the effect of the induced magnetic field $B_Z$.

(III) Meanwhile, part of the argon gas injected from the nozzle 15 toward the electrode 18 passes through the first hole 19. However, another part of the injected gas passes through the eight second holes 20 and enters the second chamber 30. For this reason, the amount of gas molecules passing through the first hole 19 together with the electrons is decreased to increase the electron extraction efficiency. Note that during an operation, the internal pressure of the first chamber is several hundreds mTorr, whereas the internal pressure of the second chamber is several mTorr. With an increase in difference in internal pressure between the two chambers, the ventilation effect by means of the second holes 20 becomes more conspicuous.

(IV) The extracted electrons move downward in the second chamber 30 with spiral motion. When the electrons collide with the bottom plate 34 of the second chamber 30, the surface of the bottom plate 34 is charged up, and the electrons are reflected due to the repulsive forces of the electrons themselves. As a result, the electrons vertically reciprocate in the second chamber 30. As a result, PIG discharge generates in the second chamber 30.

(V) A $BF_3$ gas is introduced into the second chamber in an evacuated state at 0.2 to 1.0 SCCM, and the interval pressure of the second chamber is set to be 0.001 to 0.02 Torr in advance. Since the direction of the motion of the electrons is perpendicular to the introducing direction of the $BF_3$ gas (X-axis direction) in the second chamber whose atmosphere is set in this manner, a large number of electrons collide with $BF_3$ gas molecules to cause the discharge.

At this time, the side wall 30*a* of the second chamber 30 receives a plasma attack to generate conductive particles. These particles tend to adhere to the upper surface of the insulating member. However, since the shadow with respect to a plasma is formed at the contacting portion 29 between the anode electrode 18 and the insulating plate 22, adhesion of the conductive particles to the contacting portion 29 is avoided, thus preventing an insulating fault. For the same reason, an insulation fault between the side wall 30*a* and the bottom plate 34 can be prevented.

(VI) Positive ions are extracted from the $BF_3$ plasma through the extraction port 32 and are introduced into the end station so as to be doped in a semiconductor wafer.

According to the first embodiment, the number of electrons to be drawn from the first chamber (11, 16) into the second chamber 30 can be increased, as compared with the conventional system, while the second plasma is maintained in a stable state, thus increasing the ion production efficiency.

In addition, since the protective mechanism 21 is mounted on the anode electrode 18, damage to the anode electrode 18 by the second plasma can be prevented, and the service life of the electrode can be greatly prolonged.

Figure 7:
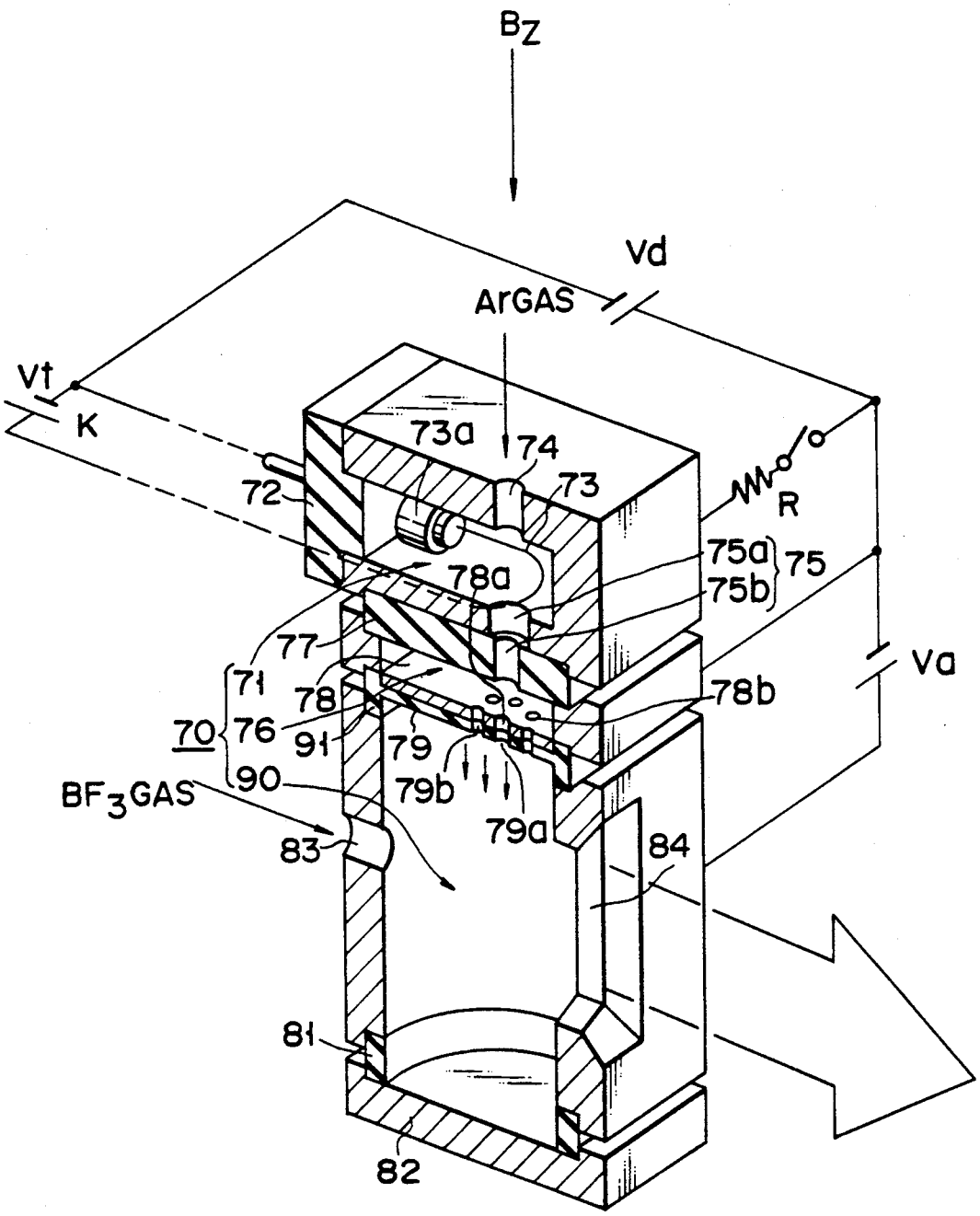
FIG. 7 is a schematic view showing an ion source according to the second embodiment of the present invention.

The second embodiment of the present invention will be described below with reference to FIGS. 7 and 8. A description of portions common to the first and second embodiments will be omitted.

Figure 8:
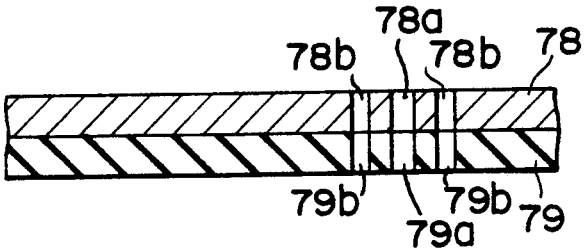
FIG. 8 is a longitudinal sectional view showing the electrode according to the second embodiment and its protective mechanism.

As shown in FIG. 8, an insulating plate 79 is bonded to the lower surface of an electrode 78 in the second embodiment. The electrode 78 is tungsten plate. The insulating plate 79 is a BN plate or an $Si_3N_4$ plate. Note that an insulating layer may be coated on the lower surface of the electrode 78 in place of the insulation plate 79.

In the first chamber, those regions other than the electron-emitting region (e.g., the region surrounding the filament 73) may be covered with an insulating material. For example, the stem 3*a* may be covered with an insulating material.

Such an electrode 78 has a simpler structure than the electrode 18 in the first embodiment and can be easily manufactured. In addition, since the lower surface of the electrode 78 is protected from a plasma attack, the service life of the electrode can be prolonged.

Such an electrode 78 has a simple structure and can be easily manufactured. If the electrode 78 is used, since the path of electrons passing through the first hole 78*a*, 79*a* is shortened in length, a discharge does not easily occur in the first hole 78*a*, 79*a*. For this reason, the number of second holes 78*b* can be decreased from eight to four to six.

In each of the above-described embodiments, the ion source is used for the ion implantation system. However, the ion source of the present invention can be used for other systems using plasmas, such as a plasma etching system, a plasma ashing system, a plasma CVD system, and an X-ray generator.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

What is claimed is:

1. An ion source for producing an ionized gas by discharge excitation using an electron beam, comprising:

a first chamber for producing a first plasma by causing electric discharge in a first gas contained in an electron-emitting region, said first chamber including:

a main chamber having electron generating means arranged therein, and a sub-chamber communicating with said main chamber through a nozzle;

means for supplying the first gas for a discharge into said main chamber;

electron extracting means, having only a single electrode, for extracting electrons from the first plasma;

a second chamber for producing a second plasma by discharge excitation of the extracted electrons and ionizing a second gas as a source gas; and means for supplying the second gas into said second chamber;

said single electrode including:

a first hold, a center of which is coaxial with a center of an opening of said nozzle, for allowing the extracted electrons to pass therethrough and to move into said second chamber, and second holes, arranged around the first hole and surrounding the first hole, for allowing part of the first gas injected from said nozzle to pass therethrough and to move into said second chamber.

2. An ion source according to claim 1, wherein said single electrode is provided between the sub-chamber and the second chamber.

3. An ion source according to claim 1, wherein said single electrode includes the second holes which are positioned in a range of 2.5 to 10 mm from the center of the first hole.

4. An ion source according to claim 1, wherein said single electrode includes the second holes which are constituted by four to eight circular holes.

5. An ion source according to claim 1, wherein said single electrode includes the second holes which are arranged on the same circumference.

6. An ion source according to claim 1, wherein said single electrode includes the first hole which is a circular hole having a diameter of 2.0 to 3.0 mm.

7. An ion source according to claim 1, wherein aid single electrode is a plate having a thickness of 1.0 to 3.5 mm.

8. An ion source according to claim 1, wherein said single electrode is made of a plate consisting of tungsten.

9. An ion source according to claim 2, wherein a power source of said electron extracting means is capable of applying a maximum voltage of 150 volts between said single electrode and a side wall of said second chamber.

10. An ion source for producing an ionized gas by discharge excitation using an electron beam, comprising:

a first chamber for producing a first plasma by causing electric discharge in a first gas contained in an electron-emitting region, said first chamber including a main chamber having electron generating means contained therein and a sub-chamber communicating with the main chamber through a nozzle;

electron extracting means for extracting electrons from the first plasma, the electron extracting means having only a single electrode with a primary opening, aligned to the nozzle, for passage of extracted electrons, the primary opening being surrounded by a plurality of secondary openings for passing the first gas;

a second chamber for producing a second plasma by discharge excitation of the extracted electrons and ionizing a second gas as a source gas;

means for supplying the second gas into said second chamber; and insulating means for insulating regions whose potential levels are lower than a potential level of the first plasma produced in the first chamber.

11. An ion source according to claim 10, wherein said insulating means is provided inside the sub-chamber on an upper surface thereof.

12. An ion source according to claim 10, wherein said insulating means includes boron nitride or silicon nitride.

13. An ion source for producing an ionized gas by discharge excitation using an electron beam, comprising:

a first chamber for producing a first plasma by causing electric discharge in a first gas contained in an electron-emitting region, said first chamber including:

a main chamber having electron generating means arranged therein, and a sub-chamber communicating with said main chamber through a nozzle;

means for supplying the first gas for a discharge into said main chamber;

electron extracting means for extracting electrons from the first plasma, the electron extracting means having only a single electrode with a primary opening, aligned to the nozzle, for passing extracted electrons, the primary opening being surrounded by a plurality of secondary openings for passing the first gas;

a second chamber having plural insulating members, for producing a second plasma by discharge excitation of the extracted electrons and ionizing a second gas as a source gas;

means for supplying the second gas into said second chamber; and means for preventing adhesion of flied conductive particles in the second chamber, wherein said particle-adhesion preventing means serves as a shadow with respect to the second plasma due to at least part of said insulating members of the second chamber.

14. An ion source according to claim 13, wherein said particle-adhesion preventing means is provided on a contacting portion between said single electrode and the insulating member which is covered with a lower surface of said single electrode.

15. An ion source according to claim 13, wherein said particle-adhesion preventing means is provided on a contacting portion between a bottom plate and a support member in the second chamber.

* * * * *